US007201568B2

(12) United States Patent
Sakamoto et al.

(10) Patent No.: US 7,201,568 B2
(45) Date of Patent: Apr. 10, 2007

(54) SCROLL FLUID MACHINE

(75) Inventors: Susumu Sakamoto, Kanagawa-ken (JP); Kazutaka Suefuji, Kanagawa-ken (JP)

(73) Assignee: Kabushiki Kaisha Hitachi Seisakusho, Tokyo (JP)

( * ) Notice: Subject to any disclaimer, the term of this patent is extended or adjusted under 35 U.S.C. 154(b) by 321 days.

(21) Appl. No.: 10/721,193

(22) Filed: Nov. 26, 2003

(65) Prior Publication Data

US 2004/0105770 A1 Jun. 3, 2004

(30) Foreign Application Priority Data

Nov. 29, 2002 (JP) ..... 2002/348396

(51) Int. Cl.
*F03C 2/00* (2006.01)
*F04C 18/00* (2006.01)

(52) U.S. Cl. ..... 418/60; 418/55.1; 418/55.2; 418/55.5; 418/57; 417/410.5

(58) Field of Classification Search ..... 418/55.1–55.5, 418/57, 60; 417/410.5
See application file for complete search history.

(56) References Cited

U.S. PATENT DOCUMENTS

| | | | | |
|---|---|---|---|---|
| 4,382,754 | A * | 5/1983 | Shaffer et al. | 418/55.2 |
| 6,068,459 | A * | 5/2000 | Clarke et al. | 418/55.4 |
| 6,267,572 | B1 * | 7/2001 | Suefuji et al. | 418/55.5 |
| 6,511,308 | B2 * | 1/2003 | Shaffer | 418/55.2 |

FOREIGN PATENT DOCUMENTS

| | | | |
|---|---|---|---|
| JP | 10184569 | A * | 7/1998 |
| JP | 200356193 | A * | 12/2000 |
| JP | 2003097462 | A * | 4/2003 |

* cited by examiner

*Primary Examiner*—Theresa Trieu
(74) *Attorney, Agent, or Firm*—Wenderoth, Lind & Ponack, L.L.P.

(57) ABSTRACT

A scroll fluid machine has a low-pressure stage compression part for compressing a fluid sucked in from the outside between mutually overlapping wrap portions of two scroll members performing a relative orbiting motion and a high-pressure stage compression part for compressing the fluid sucked in from the low-pressure stage compression part between mutually overlapping wrap portions of two scroll members performing a relative orbiting motion. The scroll members in the low-pressure stage compression part have a larger radial gap between the wrap portions than that of the scroll members in the high-pressure stage compression part.

4 Claims, 4 Drawing Sheets

SCROLL FLUID MACHINE

BACKGROUND OF THE INVENTION

The present invention relates to a scroll fluid machine suitable for use to compress a fluid, e.g. air.

In a generally known twin wrap type scroll fluid machine, two pairs of fixed and orbiting scroll members are provided respectively at two axial ends of a casing, and an electric motor for orbitally driving the two orbiting scroll members is provided in the casing (for example, see Japanese Patent Application Unexamined Publication (KOKAI). No. 2000-356193).

In this type of conventional twin wrap type scroll fluid machine, the fixed scroll member and the orbiting scroll member provided at one axial end of the casing form, in combination, compression chambers of a low-pressure stage, and the fixed scroll member and the orbiting scroll member provided at the other axial end of the casing form, in combination, compression chambers of a high-pressure, stage.

The fixed scroll member of the high-pressure stage is connected at its suction side to the discharge side of the fixed scroll member of the low-pressure stage by using piping or the like. Thus, a fluid compressed in and discharged from the compression chambers of the low-pressure stage is further compressed in the compression chambers of the high-pressure stage, thereby performing two-stage compression of the fluid.

Incidentally, in existing scroll fluid machines that perform two-stage compression as in the case of the above-described conventional twin wrap type, the fixed and orbiting scroll members are formed so that the radial gap formed between the respective wrap portions of the scroll members is minimized, and the radial gap of the low-pressure stage and the radial gap of the high-pressure stage are of approximately the same size.

The spiral wrap portions of the fixed and orbiting scroll members are formed from circumferentially extending plate-shaped walls, respectively. Each plate-shaped wall is subjected to heat generated by gas-compression effect when the fluid is compressed in the compression chambers. Consequently, a large temperature difference occurs between the inner and outer peripheral sides of the plate-shaped wall. Owing to the temperature gradient, the wrap portions are likely to be thermally deformed. Therefore, when the wrap portions are formed so that the radial gap therebetween is merely minimized, the wrap portions may contact or interfere with each other owing to the influence of thermal deformation. This causes degradation of reliability of the scroll fluid machine.

On the other hand, if the radial gap is increased to avoid contact or interference between the wrap portions, it becomes easy for the compressed fluid in the compression chambers to leak through the radial gap between the wrap portions. This makes it impossible to improve the performance of the scroll fluid machine.

In assembling a scroll compressor, it is necessary, when two scroll members are mated with each other, to adjust the position of each wrap portion with high accuracy so that the wrap portions will not contact or interfere with each other. In a scroll compressor having two different types of wrap portions for the high-pressure stage and the low-pressure stage, in particular, the position adjustment becomes even more difficult, and the number of man-hours needed to machine and assemble component parts increases unfavorably.

The present invention was made in view of the above-described problems with the prior art.

An object of the present invention is to provide a scroll fluid machine wherein the radial gap between the wrap portions in the low-pressure stage and that in the high pressure stage are made different from each other, thereby making it possible to reduce the influence of thermal deformation, minimize the leakage of fluid, improve the machine performance during compressing operation, etc. and reduce the number of man-hours needed to manufacture the scroll fluid machine.

BRIEF SUMMARY OF THE INVENTION

The present invention is applicable to a scroll fluid machine having a low-pressure stage compression part for compressing a fluid sucked in from the outside between mutually overlapping wrap portions of two scroll members performing a relative orbiting motion. The scroll fluid machine further has a high-pressure stage compression part for compressing the fluid sucked in from the low-pressure stage compression part between mutually overlapping wrap portions of two scroll members performing a relative orbiting motion.

According to a feature of the present invention, the scroll members in the low-pressure stage compression part have a larger radial gap between these wrap portions than that of the scroll members in the high-pressure stage compression part.

By making the radial gap formed between the wrap portions of the high-pressure stage compression part smaller than the radial gap in the low-pressure stage compression part, as stated above, it is possible to minimize the leakage of fluid from the compression chambers in the high-pressure stage compression part through the radial gap.

According to another feature of the present invention, the scroll members in the high-pressure stage compression part provide a higher value of pressure rise than in the low-pressure stage compression part. Accordingly, in the compression chambers of the low-pressure stage-compression part, the pressure difference between adjacent compression chambers is smaller than in the high-pressure stage compression part. Therefore, even if the radial gap in the low-pressure stage is made larger than in the high-pressure stage, the leakage of fluid can be minimized satisfactorily. Accordingly, machining can be performed more easily in the low-pressure stage compression part than in the high-pressure stage compression part. Consequently, the production cost can be reduced in total.

According to another feature of the present invention, the wrap portions of the scroll members in the high-pressure stage compression part have a smaller wrap height than that of the wrap portions of the scroll members in the low-pressure stage compression part.

In this case, the reduction in wrap height of the wrap portions in the high-pressure stage compression part makes it possible to minimize thermal deformation of the wrap portions. Even if the radial gap between the wrap portions is reduced in the high-pressure stag compression part, the wrap portions can be prevented from contacting each other. In this case, the wrap portions in the low-pressure stage compression part become more likely to be thermally deformed because the wrap height is increased. However, the wrap portions can be prevented from contacting each other by increasing the radial gap between the wrap portions.

According to another feature of the present invention, the low-pressure stage compression part comprises a low-pressure stage fixed scroll member and a low-pressure stage orbiting scroll member, and the high-pressure stag compression part comprises a high-pressure stage fixed scroll member and a high-pressure stage orbiting scroll member, and the low-pressure stage scroll members and the high-pressure stage scroll members are provided spaced away from each other.

In this case, because the low-pressure stage scroll members and the high-pressure stage scroll members are provided spaced away from each other, position adjustment and machining can be readily performed for the fixed scroll member and the orbiting scroll member in the low-pressure stage compression part, in which the radial gap is large.

According to another feature of the present invention, the scroll fluid machine further has an electric motor having a single output shaft. The low-pressure stage orbiting scroll member and the high-pressure stage orbiting scroll member are provided respectively at both ends of the output shaft.

In this case, machining and position adjustment of the orbiting and fixed scroll members in the high-pressure stage can be performed preferentially because the radial gap in the low-pressure stage is large so that machining and position adjustment can be performed more easily in the low-pressure stage than in the high-pressure stage.

DETAILED DESCRIPTION OF THE INVENTION

Figure 1:
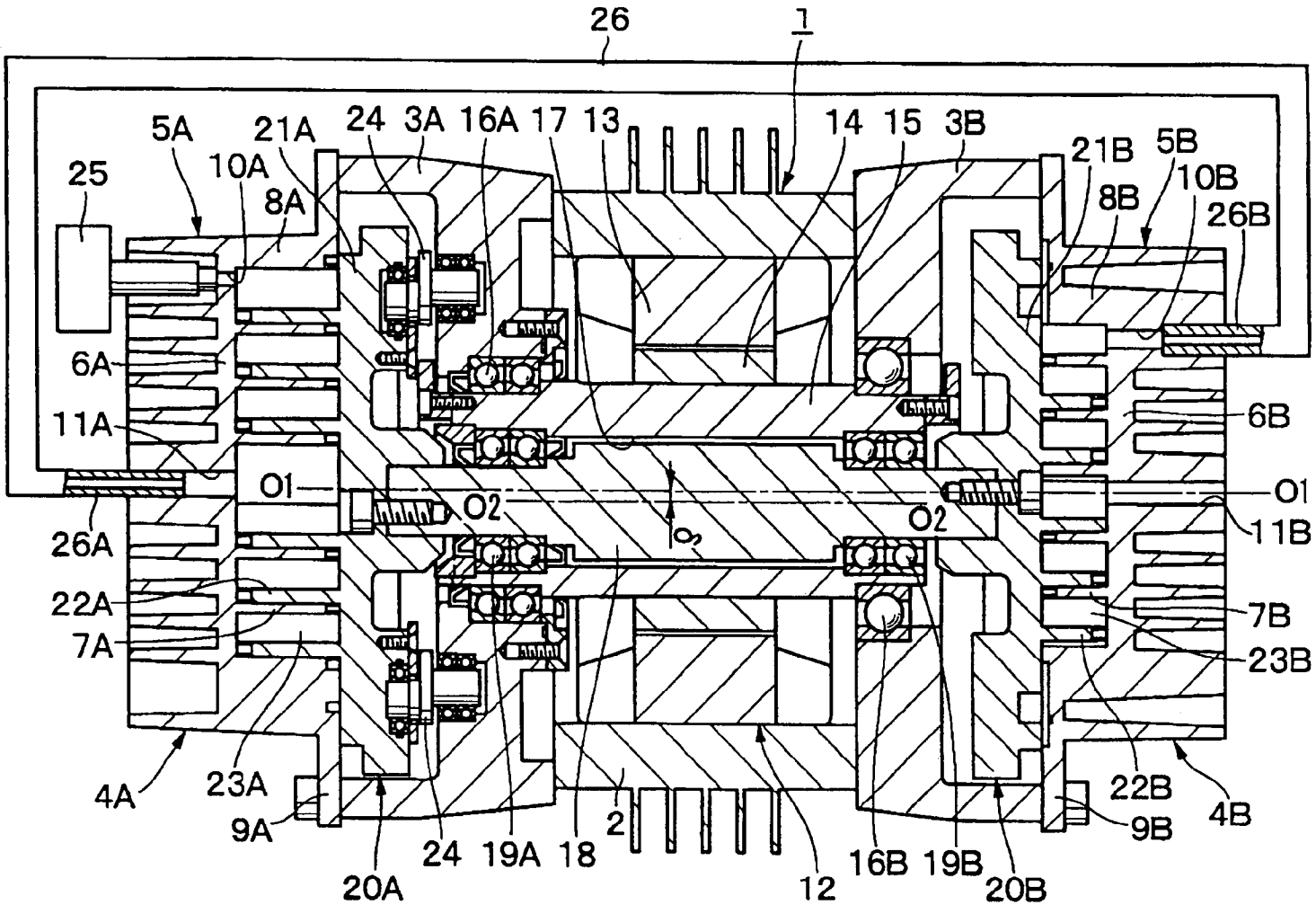
FIG. 1 is a longitudinal sectional view showing a scroll air compressor according to an embodiment of the present invention.

A scroll fluid machine according to an embodiment of the present invention will be described below-in-detail with regard to a twin wrap type scroll air compressor, by way of example, with reference to FIGS. 1 to 4 of the accompanying drawings.

A cylindrical casing 1 forms an outer frame of a of scroll air compressor. The casing 1 has a casing body 2 formed approximately in the shape of a cylinder centered at an axis O1—O1. A pair of bearing mount members (left and right) 3A and 3B are secured to the left and right ends of the casing body 2.

The bearing mount member 3A located on the left side of the casing body 2 constitutes a low-pressure scroll unit 4A in combination with a fixed scroll member, 5A, an orbiting scroll member 20A, etc. (described later). The low-pressure scroll unit 4A, serves as a low-pressure stage compression part. The bearing mount member 3B, located on the right side of the casing body 2 constitutes a high-pressure scroll unit 4B in combination with a fixed scroll member 5B, an orbiting scroll member 20B, etc. (described later). The high-pressure scroll unit 4B serves as a high-pressure stage compression part.

It should be noted that the low-pressure scroll unit 4A and the high-pressure scroll unit 4B have substantially the same constituent elements. Therefore, in the following description, the constituent elements of the low-pressure stage are suffixed with "A", and those of the high-pressure stage are suffixed with "B". In order to avoid repeated explanation in the following description of the low-pressure stage and the high-pressure stage, the following description will be made mainly of the constituent elements of the low-pressure scroll unit 4A, and a description of the constituent elements of the high-pressure scroll unit 4B will be omitted.

A fixed scroll member 5A of the low-pressure stage is provided at a side of the casing 1 where the bearing mount member 3A is provided. The fixed scroll member 5A has an approximately disk-shaped end plate 6A positioned so that the center thereof is coincident with the axis O1—O1 of the casing 1. A spiral wrap portion 7A is provided on a surface of the end plate 6A. A cylindrical portion 8A projects axially from the outer peripheral edge of the end plate 6A so as to surround the spiral wrap portion 7A. A flange portion 9A projects radially outward from the cylindrical portion 8A.

The outer periphery of the flange portion 9A of the fixed scroll member 5A is detachably attached to the opening end of the bearing mount member 3A through bolts, etc. Further, the end plate 6A of the, fixed scroll member 5A has a suction opening 10A provided in an outer peripheral portion thereof to suck a fluid, e.g. air (outside air), into compression chambers 23A (described later) therethrough. The center of the end plate 6A (on the axis O1—O1) is provided with a discharge opening 11A for compressed air.

An electric motor 12 is provided in the casing body 2 to extend between the fixed scroll member 5A of the low-pressure stage and the fixed scroll member 5B of the high-pressure stage. The electric motor 12 has a cylindrical stator 13 secured to the inner peripheral side of the casing body 2. A cylindrical rotor 14 is rotatably disposed at the inner peripheral side of the stator 13.

The electric motor 12 is positioned so that, the respective axes of the stator 13 and the rotor 14 is coincident with the axis O1—O1 of the casing 1. By rotating the rotor 14, the electric motor 12 drives a, rotating shaft 15 (described later) to rotate about the axis O1—O1.

A stepped cylindrical rotating shaft 15 is rotatably supported by the bearing mount members 3A and 3B at the left and right sides of the casing 1 through rotary bearings 16A and 16B. The rotating shaft 15 is a hollow shaft member fitted into the rotor 14 of the electric motor 12 by press-fitting or the like. The rotating shaft 15 rotates about the axis O1—O1 together with the rotor 14 as one unit.

The rotating shaft 15 extends-axially through the rotor 14 of the electric motor 12 and constitutes an output shaft of the electric motor 12 in combination with an orbiting shaft 18 (described later). The inner peripheral wall of the rotating shaft 15 forms a stepped eccentric hole 17 that is eccentric by a dimension 6 with respect to the axis O1—O1 of the casing 1 and so forth.

An orbiting shaft 18 is provided in the eccentric hole 17 of the rotating shaft 15 rotatably relative to the rotating shaft 15. The orbiting shaft 18 is a solid stepped shaft member and disposed on an eccentric axis O2—O2 that is eccentric by a dimension δ with respect to the axis O1—O1 of the casing 1 and so forth. The orbiting shaft 18 is supported in the eccentric hole 17 of the rotating shaft 15 rotatably relative to the rotating shaft 15 by using orbiting bearings 19A and 19B. The orbiting shaft 18 constitutes the output shaft of the electric motor 12 in combination with the rotating shaft 15.

Both axial end portions of the orbiting shaft 18 project axially from both ends of the eccentric hole 17 of the rotating shaft 15. Orbiting scroll members. 20A and 20B (described later) are provided on the projecting end portions of the orbiting shaft 18 spaced away from each other in the axial direction. The orbiting shaft 18 follows the rotation of the rotating shaft 15 to give an orbiting motion to the orbiting scroll members 20A and 20B.

The orbiting scroll member 20A of the low-pressure stage is orbitably provided in the casing 1 so as to face the fixed scroll member 5A. The orbiting scroll member 20A comprises an approximately disk-shaped end plate 21A and a spiral wrap portion 22A standing on the surface of the end plate 21A. The orbiting scroll member 20B of the high-pressure stage also comprises an approximately disk-shaped end plate 21B and a spiral wrap portion 22B.

The low-pressure stage orbiting scroll member 20A and the high-pressure stage orbiting scroll member 20B are arranged as follows. Central portions of the respective backs of the end plates 21A and 21B are integrally secured to both ends of the orbiting shaft 18 by using bolts or the like. Thus, the orbiting scroll members 20A and 20B are allowed to perform an orbiting motion together with the orbiting shaft 18 by driving force from the electric motor 12. The orbiting scroll members 20A and 20B are positioned so that the wrap portions 22A and 22B overlap the wrap portions 7A and 7B of the fixed scroll members 5A and 5B, respectively, with a predetermined offset angle (e.g. 180 degrees).

The fixed scroll member 5A and the orbiting scroll member 20A of the low-pressure stage define low-pressure stage compression chambers 23A between their respective wrap portions 7A and 22A in different radial, positions. The fixed scroll member 5B and the orbiting scroll member 20B of the high-pressure stage define high-pressure stage compression chambers 23B between their respective wrap portions 7B and 22B in different radial positions.

Figure 2:
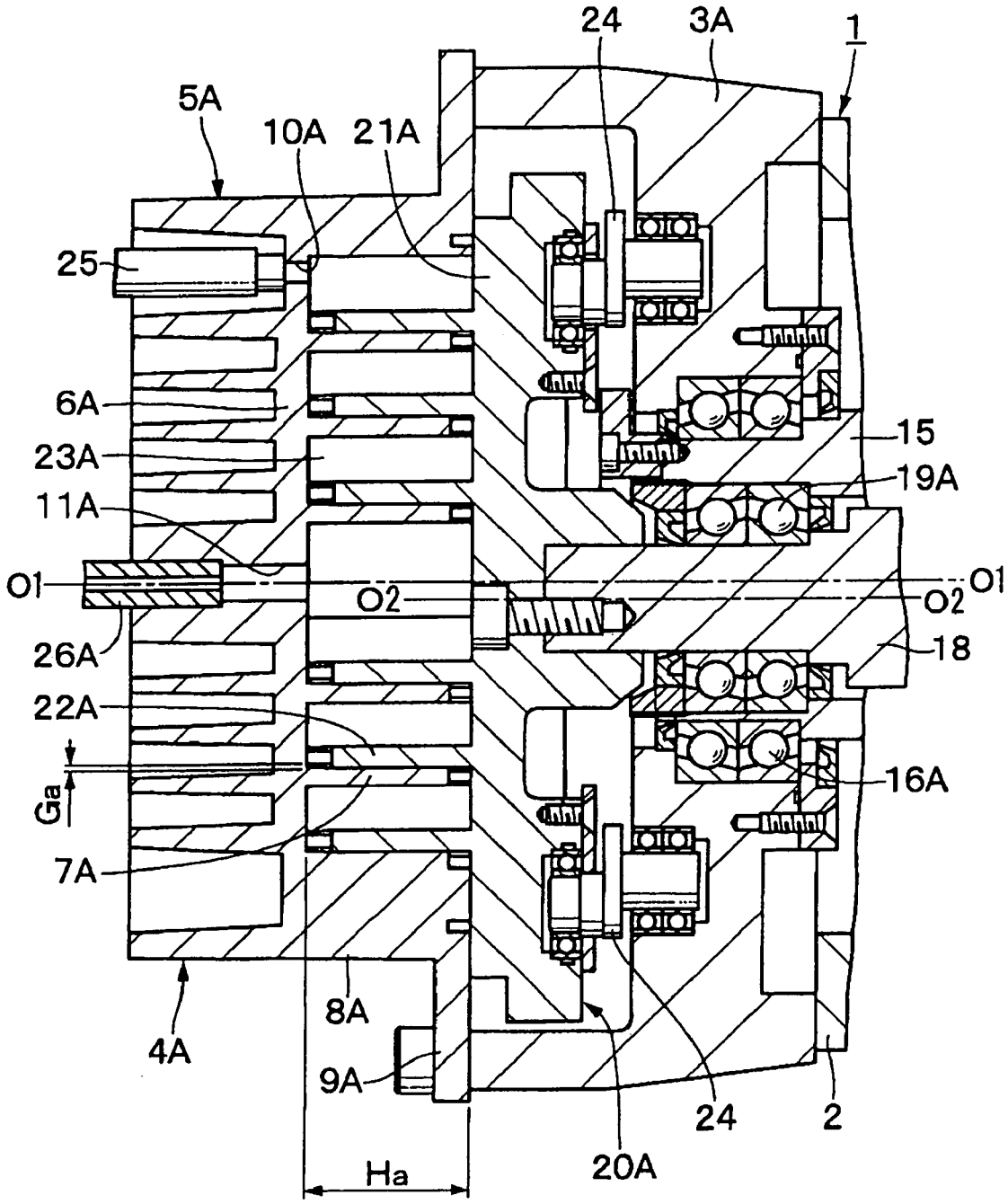
FIG. 2 is an enlarged longitudinal sectional view showing a low-pressure scroll unit of the scroll air compressor in FIG. 1.

In the fixed scroll member 5A and the orbiting scroll member 20A of the low-pressure stage, as shown in FIG. 2, the wrap portions 7A and 22A have a relatively large wrap height Ha (axial length), and the radial gap Ga between the wrap portions 7A and 22A is set at about 0.05 to 0.07 mm, for example.

Figure 3:
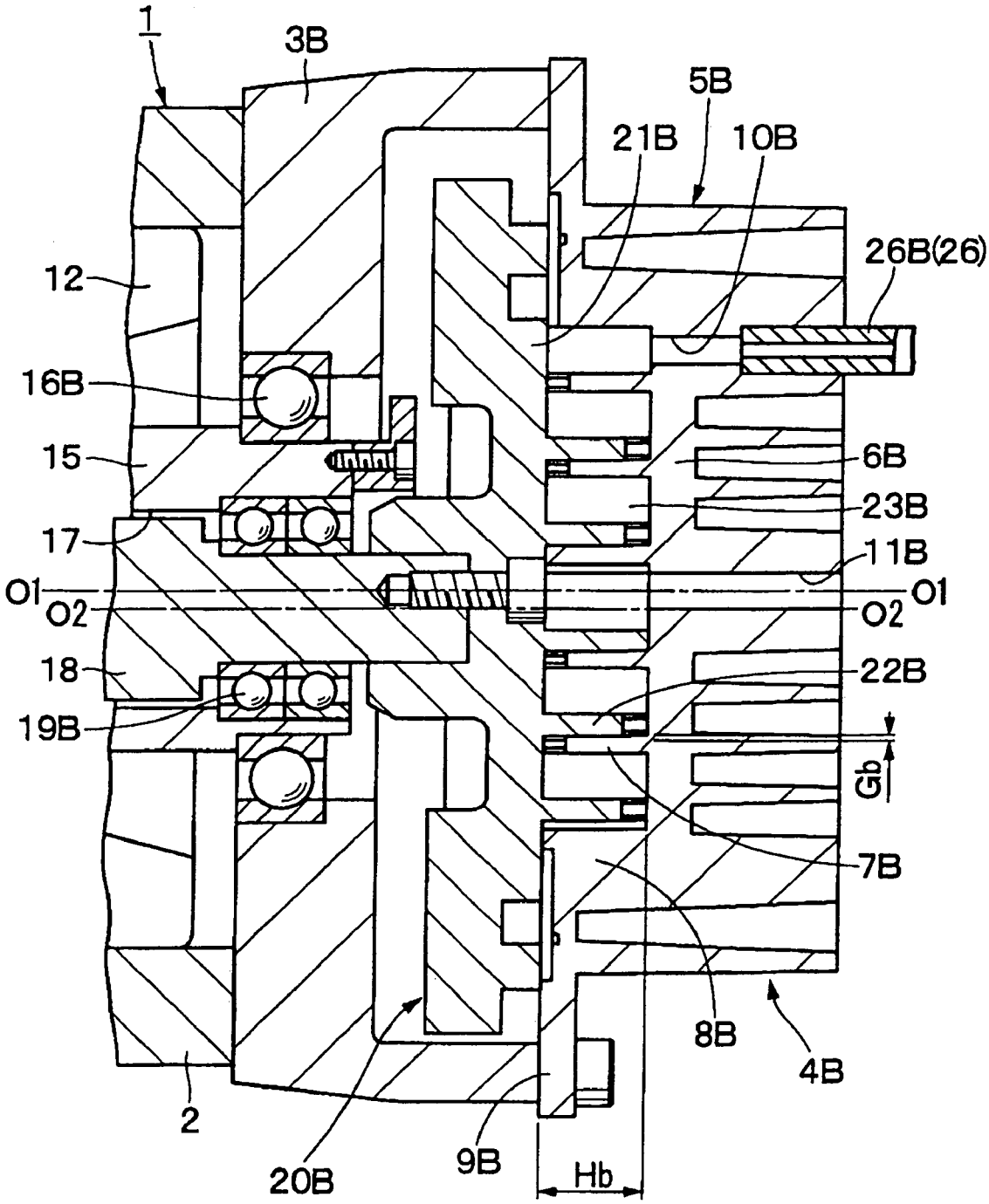
FIG. 3 is an enlarged longitudinal sectional view showing a high-pressure scroll unit of the scroll air compressor in FIG. 1.

In the fixed scroll member 5B and the orbiting, scroll member 20B of the high-pressure stage, as shown in FIG. 3, the wrap portions 7B and 22B have a relatively small wrap height Hb, and the radial gap Gb between the wrap portions 7B and 22B is set at about 0.03 to 0.04 mm, for example.

Thus, the wrap height Hb of the wrap portions 7B and 22B in the high-pressure stage is smaller than the wrap, height Ha of the wrap portions 7A and 22A in the low-pressure stage (Hb<Ha). The radial gap Ga of the wrap portions 7A and 22A in the low-pressure stage is larger than the radial gap Gb of the wrap portions 7B and 22B in the high-pressure stage (Ga>Gb).

Auxiliary cranks 24 serve as a rotation preventing mechanism for preventing the orbiting-scroll member 20A from rotating on its own axis. Each auxiliary crank 24 is provided in the low-pressure scroll unit 4A at a position between the bearing mount member 3A of the casing 1 and the end plate 21A of the orbiting scroll member 20A. Similar auxiliary cranks (not shown) are provided in the high-pressure scroll unit 4B at respective positions between the bearing mount member 3B of the casing 1 and the end plate 21B of the orbiting scroll member 20B.

A suction filter 25 is provided in the low-pressure scroll unit 4A. The suction filter 25 is detachably provided in the suction opening 10A of the fixed scroll member 5A of the low-pressure stage to clean outside air (intake air) or the like sucked in from the suction opening 10A toward the compression chambers 23A and to function also as a silencer for minimizing noise generated when air or the like is sucked in.

Piping 26 serves as a communicating passage for communication between the compression chambers 23A of the low pressure stage and the compression chambers 23B of the high-pressure stage. The piping 26 is provided outside the casing 1 to extend between the fixed scroll member 5A of the low-pressure stage and the fixed-scroll member 5B of the high-pressure stage. One end portion 26A of the piping 26 is connected to a discharge opening 11A of the fixed scroll member 5A. The other end portion 26B of the piping 26 is connected to a suction opening 10B of the fixed scroll member 5B.

The twin wrap type scroll air compressor according to this embodiment has the above-described arrangement. Next, the operation of the scroll air compressor will be described.

First, when the rotor 14 is driven to rotate by supplying electric power to the stator 13 of the electric motor 12, the rotating shaft 15, which is integral with, the rotor 14, rotates about the axis O1—O1 together with the rotor 14 as one unit. In response to the rotation of the rotating shaft 15, the orbiting shaft 18, which is positioned on the axis O2—O2, performs an orbiting motion with an orbiting radius δ in the eccentric hole 17 of the rotating shaft 15.

Thus, the orbiting scroll members 20A and 20B which are provided at both ends of the orbiting shaft 18, perform an orbiting motion with an orbiting radius δ with respect to the fixed scroll members 5A and 5B. Consequently, in the low-pressure scroll unit 4A, outside air is sucked in from the suction opening 10A provided in the outer peripheral portion of the fixed scroll member 5A through the suction filter 25, and the sucked air is successively compressed in the compression chambers 23A.

In this way, the air is compressed to a pressure of the order of 0.3 MPa, for example, in the compression chambers 23A between the fixed scroll member 5A and the orbiting scroll member 20A of the low-pressure stage. The compressed air is discharged from the discharge opening 11A, which is provided in the center of the fixed scroll member 5A into the piping 26. In the high-pressure scroll unit 4B, the compressed air is supplied to the suction opening 10B of the fixed scroll member 5B through the piping 26.

The supplied compressed air is further compressed to a pressure of the order of 1.0 MPa, for example, in the compression chambers 23B between the fixed scroll member 5B and the orbiting scroll member 20B of the high-pressure stage. The compressed air is discharged to the outside from the discharge opening 11B provided in the center of the fixed scroll member 5B, and stored, for example, in an air tank. (not shown).

For example, in a case where the low-pressure stage compression chambers 23A have a volume Va, and the high-pressure stage compression chambers 23B have a volume Vb, the pressures Pa and Pb of compressed air produced in the compression chambers 23A and 23B satisfy the following relationship according to Boyle's law under the condition that the temperature is held constant:

$$Pa \times Va = Pb \times Vb \quad (1)$$

Therefore, when the pressure Pb at the high-pressure stage is about three times as high as the pressure Pa at the low-pressure stage (Pb≈3×Pa), it is necessary according to the expression (1) to reduce the volume Vb of the high pressure stage to about ⅓ of the volume Va of the low-pressure stage (Vb≈Va/3).

The relationship between the volumes Va and Vb approximately corresponds to the relationship between the wrap height Ha of the low-pressure stage wrap portions 7A and 22A and the wrap height Hb of the high-pressure stage wrap portions 7B and 22B. Therefore, the high-pressure stage wrap portions 7B and 22B are formed so that the wrap height Hb is smaller than the wrap height Ha of the low-pressure stage wrap portions 7A and 22A (Hb<Ha).

However, a large temperature difference occurs between the inner and outer peripheral sides of the spiral wrap portions 7A, 7B, 22A and 22B. Owing to the temperature gradient, these wrap portions are likely to be thermally deformed. The thermal deformation occurs to a larger extent on the low-pressure stage wrap portions 7A and 22A, which have a large wrap height Ha, than on the high-pressure stage wrap portions 7B and 22B, which have a small wrap height Hb.

Meanwhile, if the radial gap Ga (Gb) of the wrap portions 7A and 22A (7B and 22B) is reduced to as small as possible, the amount of leakage from the compression chambers 23A (23B) can be minimized. Thus, the compression performance improves. However, if the radial gaps Ga and Gb are reduced, machining of the wrap portions 7A, 7B, 22A and 22B will come to require a high technical skill and become complicated, causing the manufacturing operating efficiency to be degraded.

Therefore, this embodiment adopts the above-described arrangement. That is, in the low-pressure stage where the wrap height Ha of the wrap portions 7A and 22A is large, the radial gap Ga between the wrap portions 7A and 22A is set large, whereas in the high-pressure stage where the wrap height Hb is small, the radial gap Gb between the wrap portions 7B and 22B is set small (Gb<Ga).

Thus, the low-pressure stage wrap portions 7A and 22A having a large wrap height Ha are ensured a large radial gap Ga therebetween, thereby making thermal deformation of the wrap portions 7A and 22A allowable to a certain extent. Consequently, it is possible to eliminate such problems as contact or interference between the wrap portions 7A and 22A during compressing operation.

Meanwhile, the high-pressure stage wrap portions 7B and 22B can minimize thermal deformation because the wrap height Hb is small. Therefore, the high-pressure stage wrap portions 7B and 22B can be formed with a sufficiently small radial gap Gb. Consequently, it is possible to reduce the amount of leakage of compressed air and hence possible to improve the compression performance in the high-pressure stage.

In comparison between the low-pressure stage compression chambers 23A and the high-pressure stage compression chambers 23B, the compression ratios of sucked air compressed in these compression chambers until it is discharged therefrom are approximately equal to each other. However, in the high-pressure stage compression chambers 23B, the volume Vb in the above-described expression (1) is smaller than the volume Va of the low-pressure stage compression chambers 23A. Therefore, the pressure difference between the compression chambers 23B formed between the wrap portions 7B and 22B, is large. Accordingly the amount of leakage of compressed air is likely to increase relatively.

In contrast the low-pressure stage compression, chambers 23A have volume Va larger than the volume Vb of the high-pressure stage. Therefore, the pressure difference between the compression chambers 23A formed between the wrap portions 7A and 22A is small. Accordingly, the amount of leakage of compressed air can be reduced satisfactorily if the radial gap Ga between the wrap portions 7A and 22A is reduced to ascertain extent.

The relationship between the radial gap and the overall adiabatic efficiency of the compressor (e.g. the ratio between the shaft power of the electric motor 12 to the theoretical adiabatic power for compressed air) was confirmed by using a trial machine. As a result, characteristic curves 27 and 28 as shown in FIG. 4 were obtained.

Figure 4:
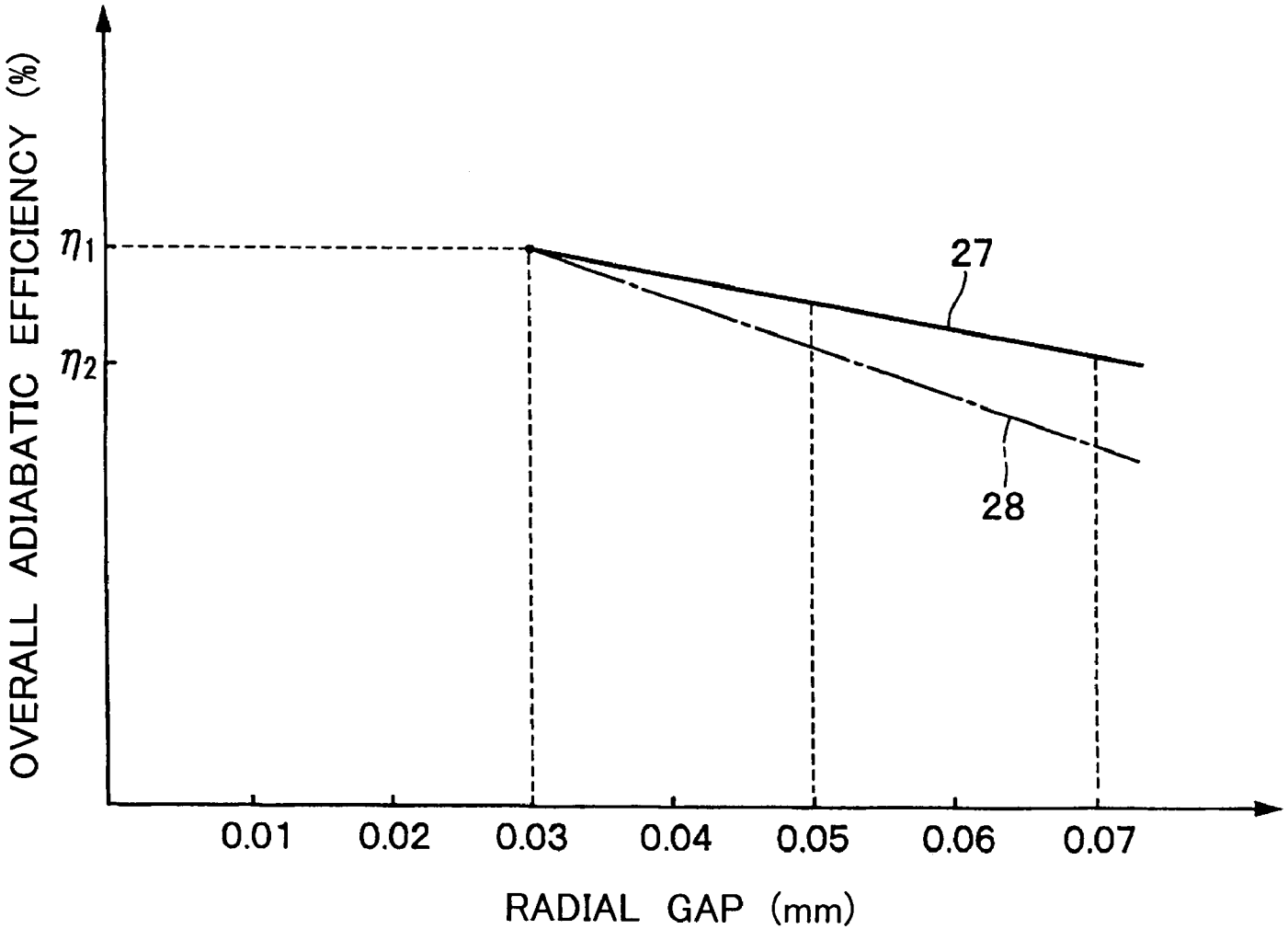
FIG. 4 is a characteristic chart showing the relationship between the radial gap and the overall adiabatic efficiency.

In this case, the characteristic curve 27, which is shown by a solid line in FIG. 4, represents characteristics obtained when the low-pressure stage radial gap Ga was changed in the range of from 0.03 km to 0.07 mm with the high-pressure stage radial gap Gb fixed at 0.03 mm, by way of example. The characteristic curve 28, which, is shown by a chain line in FIG. 4, represents characteristic obtained when the high-pressure stage radial gap Gb was changed in the range of from 0.03 mm to 0.07 mm with the low-pressure stage radial gap Ga fixed at 0.03 mm, by way of example.

As will be understood from FIG. 4, when both the low-pressure stage radial gap Ga and the high-pressure stage-radial gap Gb are set at 0.03 mm, the overall adiabatic efficiency of the compressor can be ensured as an efficiency $\eta 1$ of about 66%, by way of example. Even when the low pressure stage radial gap Ga is changed in the range of from 0.03 mm to 0.07 mm, the overall adiabatic efficiency can be ensured at a level above an efficiency $\eta 2$ (e.g. 59%), as shown by the solid-line characteristic curve 27.

However, when the high-pressure stage radial gap Gb is changed from 0.03 mm to 0.07 mm, as shown by the chain line characteristic curve 28 in FIG. 4, the overall adiabatic efficiency decreases below the efficiency $\eta 2$ as the radial gap Gb is increased. Thus, the compressor performance is degraded.

Therefore, according to this embodiment, the low-pressure stage wrap portions 7A and 22A, which have a large wrap height Ha, are formed with a large radial gap Ga, whereas the high-pressure stage wrap portions 7B and 22B, which have a small wrap height Hb, are formed with a small radial gap Gb, thereby making it possible to ensure the required sealing performance in the high-pressure stage and to reduce the leakage of compressed air. In the low-pressure stage, it is possible to ensure a radial gap Ga large enough to allow thermal deformation of the wrap portions 7A and 22A.

Thus, the low-pressure stage wrap portions 7A and 22A and the high-pressure stage wrap portions 7B and 22B can be formed with appropriate radial gaps Ga and Gb, respectively. Consequently, it is possible to improve the machining operating efficiency during manufacture, and the twin wrap type scroll air compressor can be satisfactorily improved in performance and reliability.

Further, by designing the low-pressure scroll unit 4A and the high-pressure scroll unit 4B so as to satisfy the above-described relationship (1), it is possible to prevent an unbalanced load from being applied from the left and right sides (low-pressure stage and high-pressure stage) to the rotating shaft 15 and the orbiting shaft 18, which constitute in combination the output shaft of the electric motor 12. Hence, it is possible to reduce the load on the electric motor 12 and to surely increase durability, lifetime, etc.

In the foregoing embodiment, the low-pressure stage radial gap Ga is of the order of 0.05 to 0.07 mm, and the high-pressure stage radial gap Gb is of the order of 0.03 to 0.04 mm. However, the present invention is not necessarily limited thereto. The radial gaps maybe appropriately set according to each particular model of twin wrap type scroll fluid machine. It is essential only that the low-pressure stage radial gap Ga be larger than the high-pressure stage radial gap Gb.

In the foregoing embodiment, the present invention has been described with regard to a scroll type multistage air compressor having two stages, byway of example. However, the present invention is not necessarily limited thereto but also applicable to multistage compressors, having three or more stages, for example. In such a case, radial gaps in compression parts successively lower in pressure than the highest-pressure stage compression part should be gradually increased.

The present invention may also be applied to a scroll compressor having a multiplicity of stages each comprising a scroll unit in which an orbiting scroll member has wrap portions on both sides thereof as disclosed, for example, in Japanese Patent Application Unexamined Publication KOKAI) No. Hei 7-103151. It is also possible to apply the present invention to a multistage scroll fluid machine having an intermediate path between a pre-stage compression part and a post-stage compression part as disclosed, for example, in Japanese Patent Application Unexamined Publication (KOKAI) No. Sho 54-59608. In this machine, the radial gap in the pre-stage compression part is made larger than that in the post-stage compression part.

Further, the present invention way be applied to a two-stage (multistage) scroll compressor system formed by using two ordinary scroll compressors (each comprising a fixed scroll member, an orbiting scroll member, and an electric motor). In this compressor system, the radial gap in the pre-stage compression part is made larger than that in the post-stage compression part as in the case of the above. In this case, the present invention may be applied not only to ordinary scroll compressors but also to full-rotating type scroll compressors (in which a scroll compressing unit comprises a drive scroll member and a follower scroll member) disclosed, for example, in Japanese Patent Application Unexamined Publication (KOKAI) Nos. Sho 63-80089 and Hei 3-145588. In these cases also, it is possible to obtain advantageous effects substantially similar to those offered by the twin wrap type scroll compressor according to the foregoing embodiment.

Further, in the foregoing embodiment, the present invention has been described with regard to a scroll air compressor as an example of a scroll fluid machine. However, the present invention is not necessarily limited to the scroll air compressor but may also be widely applied to other scroll fluid machines, e.g. a vacuum pump, a refrigerant compressor, etc.

As has been detailed above, according to a feature of the present invention, the scroll members in the low-pressure stage compression part have a larger radial gap between the wrap portions than that of the scroll members in the high-pressure stage compression part. Therefore, in the high-pressure stage compression part, the radial gap between the wrap portions can be reduced. Hence, it is possible to minimize the leakage of fluid from the compression chambers in the high-pressure stage compression part through the radial gap. In the low-pressure stage compression part, machining can be performed more easily than in the high-pressure stage compression part. Consequently, the production cost can be reduced in total.

According to another feature of the present invention, the scroll members in the high-pressure stage compression part, provide a higher value of pressure rise than in the low-pressure stage compression part. Accordingly, in the compression chambers of the low-pressure stage compression part, the pressure difference between adjacent compression chambers is smaller than in the high-pressure stage compression part. Therefore, even if the radial gap in the low-pressure stage is made larger than in the high-pressure stage, the leakage of fluid can be minimized satisfactorily. Accordingly, machining can be performed more easily in the low-pressure stage compression part than in the high-pressure stage compression part, and the production cost can be reduced in total.

According to another feature of the present invention, the wrap portions of the scroll members in the high-pressure stage compression part have a smaller wrap height than that of the wrap portions of the scroll members in the low-pressure stage compression part. Accordingly, in the high-pressure stage, thermal deformation of the wrap portions can be minimized by reducing the wrap height of the wrap portions, and even if the radial gap between the wrap portions is reduced, the wrap portions can be prevented from contacting each other. In this case, the wrap portions in the low-pressure stage, compression part become more likely to be thermally deformed because the wrap height is increased. However, the wrap portions can be prevented from contacting each other by increasing the radial gap between the wrap portions.

According to another feature of the present invention, the low-pressure stage scroll members and the high-pressure stage scroll members are provided spaced away from each other. Therefore, position adjustment and machining can be readily performed for the fixed scroll member and the orbiting scroll member in the low-pressure stage compression part, in which the radial gap is large.

According to another feature of the present invention, the low-pressure stage orbiting scroll member and the high-pressure stage orbiting scroll member are provided respectively at both ends of the output shaft of the electric motor. In this case, machining and position adjustment of the orbiting and fixed scroll members in the high-pressure stage can be performed preferentially because the radial gap in th low-pressure stage is large so that machining and position adjustment can be performed more easily in the low-pressure stage than in the high-pressure stage. Therefore, machining and assembling can be performed easily. Accordingly, the production cost can be reduced in total.

What is claimed is:

1. A scroll fluid machine comprising:

a casing body;

a first bearing mount member fixed to a first side of said casing body;

a second bearing mount member fixed to a second side of said casing body;

a low pressure scroll unit provided on the first side of said casing body, said low pressure scroll unit comprising a first orbital scroll member and a first fixed scroll member attached to said first bearing member, said first fixed scroll member having an end plate and a spiral wrap portion provided on a surface of the end plate, and said first orbital scroll member having an end plate and a spiral wrap portion provided on a surface of the end plate facing said first fixed scroll member; and a high pressure scroll unit provided on the second side of said casing body, said high pressure scroll unit comprising a second orbital scroll member and a second fixed scroll member attached to said second bearing member, said second fixed scroll member having an end plate and a spiral wrap portion provided on a surface of the end plate, and said second orbital scroll member having an end plate and a spiral wrap portion provided on a surface of the end plate facing said second fixed scroll member, wherein said wrap portions of said first fixed scroll member and said first orbital scroll member define a radial gap, and said wrap portions of said second fixed scroll member and said second orbital scroll member define a radial gap that is smaller than the radial gap defined by said wrap portions of said first fixed scroll member and said first orbital scroll member.

2. A scroll fluid machine according to claim 1, further comprising an electric motor provided in said casing body so as to extend between said first fixed scroll member of the low pressure scroll unit and said second fixed scroll member of the high pressure scroll unit.

3. A scroll fluid machine according to claim 2, wherein said electric motor includes an output shaft connected at opposite ends to said first and second orbital scroll members.

4. A scroll fluid machine according to claim 2, wherein a wrap height of said wrap portions of said second fixed scroll member and said second orbital scroll member is smaller that a wrap height said wrap portions of said first fixed scroll member and said first orbital scroll member.

* * * * *